US006224392B1

(12) United States Patent
Fasano et al.

(10) Patent No.: US 6,224,392 B1
(45) Date of Patent: May 1, 2001

(54) COMPLIANT HIGH-DENSITY LAND GRID ARRAY (LGA) CONNECTOR AND METHOD OF MANUFACTURE

(75) Inventors: Benjamin V. Fasano, New Windsor; Kevin M. Prettyman, Holmes, both of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/206,024

(22) Filed: Dec. 4, 1998

(51) Int. Cl.[7] ..... H01R 12/00

(52) U.S. Cl. ..... 439/66; 29/848

(58) Field of Search ..... 439/66, 81; 29/846, 29/848, 849

(56) References Cited

U.S. PATENT DOCUMENTS 5,139,427 8/1992 Boyd et al. ..... 439/66

FOREIGN PATENT DOCUMENTS 2-94492 * 4/1990 (JP) .
8-203644 * 8/1996 (JP) .

OTHER PUBLICATIONS

IBM Technical Disclosure, vol. 33, No. 5, p. 394, Oct. 1990.*

D.R. Turner, "A Technique for Evaluating Electroplating Into Small Through–Holes of Printed Wiring Boards", Caviderm Instrument, Unit Process Assemblies, Inc., Jul. 1979, pp. 32–35.

"Servometer Interconnect Contacts for Flexible Connections", Servometer Corporation, pp. 1–10.

* cited by examiner

*Primary Examiner*—Neil Abrams
(74) *Attorney, Agent, or Firm*—Ratner & Prestia; Jay H. Anderson, Esq.

(57) ABSTRACT

A compliant, high-density land grid array connector and the process of making such a connector. The process includes the steps of: (a) forming holes in a supporting substrate; (b) forming threaded sidewalls by tapping the holes; (c) plating the threaded sidewalls to form bellows-like structures; and (d) etching a surface of the supporting substrate after the plating to leave portions of the bellows-like structures protruding past a surface of the substrate. The resulting connector includes a substrate having bellows-like contacts extending from one or both sides for resiliently engaging pads such as those of an LGA module. As an alternative, the holes may be formed as blind holes. Ends of the bellows-like contacts may be roughened. The connector may also be formed by casting the substrate in a mold box having screw-like mandrels followed by steps of mandrel removal, hole plating and surface etching.

19 Claims, 5 Drawing Sheets

COMPLIANT HIGH-DENSITY LAND GRID ARRAY (LGA) CONNECTOR AND METHOD OF MANUFACTURE

FIELD OF THE INVENTION

The present invention relates, in general, to an electrical connector and, more specifically, to a compliant, high-density land grid array (LGA) connector for connecting an LGA module to a supporting substrate.

BACKGROUND OF THE INVENTION

The current design trend for connectors used in the computer field is to provide both high area density and high reliability connections between various circuit devices within a computer. Typically, integrated circuit chips are attached to a chip carrier, thermally conductive module chip carrier, circuit card, or board by solder bonding, brazing, controlled collapse chip connection (C4), wire lead bonding, metal bump bonding, tape automated bonding, or the like. High reliability for such connections is essential due to potential end product failure should poor connections of these devices occur.

There are two levels of interconnections that are typically required for electronic modules used for integrated circuit applications. The first level of interconnection is between the electronic module or substrate and the integrated circuit or chip.

The second level of interconnection is between the electronic module and a printed circuit board (PCB) or card. This is usually accomplished by a soldering process, relying on a lead metal alloy to provide both electrical and mechanical connection to the PCB or card.

For many applications the area density of the connections between the module and the PCB is low and the size of the module is only slightly larger than the chip. For these applications solder interconnections are usually acceptable. When modules become larger than about 32 mm as is the case of multi-chip modules (MCMs) which have more than one integrated circuit device and many inputs/outputs (I/Os), the reliability of solder joints for second level interconnection is compromised.

Connecting electrical terminations between the surfaces of two components, such as a ceramic chip carrier module and a glass-epoxy printed circuit board by solder requires a significant amount of compliance in the connector. This requirement is due to the non-planarity and irregularities inherent in the surfaces of the board and the module and, more importantly, their different coefficients of thermal expansion.

A solder joint is established by the strategic placement of solder balls, columns or the like between circuit elements (e.g., pads), and reflowing the solder to effect interconnection. During the cool down of the joined assembly from the reflow temperature, the solder connections at the outer most positions (typically the corners of the connection array), undergo shear stress due to differences between coefficients of thermal expansion of the module and the PCB.

Moreover, during use of the completed device, ambient heating or device generated heat causes uneven expansion of the board and the module, thereby leading to further stressing of the solder joint. The connector must accommodate this stress without severing the mechanical and electrical connection between the module and PCB. It should be noted that as the module size gets larger, the size of the interconnection array usually also increases. The mismatch due to differing coefficients of thermal expansion and the resultant shear stress in the solder also increases. For example, as the interconnection array size increases to greater than about 32 mm (1.25 inches), the stress on the outermost interconnections increases. This can sometimes be mitigated by using long solder connections between the module and the PCB as is practiced in solder column or wire column interconnection. These types of interconnects are often fragile and easily damaged during handling.

LGAs are electrical contacts located on an electrical device, which are used to provide electrical connections to the wiring within the device. The LGA typically consists of an array of metal pads, deposited through thick or thin film deposition techniques, and usually coated by plating with gold to provide non-oxidizing and highly conductive surfaces. Connections are made to these pads by metal or metallized connectors that physically contact the pads without the use of solders. The contacts between the LGA pads and the connectors are maintained by a force exerted by compressing the device with the LGA pads against the connectors. These connectors are typically arranged in an array within a socket so that a large number of electrical contacts can be made. A major advantage of LGA socket connectors is that they can be used to allow replacement of the electrical device quickly without the need to unsolder, remove, and resolder the device.

A variety of structures are used to connect the LGA pads on an electrical device to the metallized connectors. The connector used for LGAs is often made to connect two mating LGA pads positioned on each side of each connector. In this configuration the connector array is often referred to as an interposer since it is placed between opposing LGA features. Typically, interconnection features use a plurality of contacts held in a polymer laminate on centers complimentary to pads of components and PCB circuits. These contacts range from those requiring an extremely low closure force, such as those made of a conductive gel, to those requiring an intermediate force which are formed of fine conductive wire termed "fuzz" buttons and, for more rigorous applications, a type of coil spring known as a "canted" coil spring. The housings for the different applications clamp the contacts against the pads and are, accordingly, of different constructions, dependent upon the environment, vibration, and stress of the connectors.

An alternative connection method may involve the placement of connections directly on a surface by solder or electrically conductive epoxy. The solder or epoxy connects only one end of the connector to a PCB, for instance. The other end of the connector may be available to provide contact to an LGA pad and module, substrate or a different PCB.

The most widely used form of LGA socket (in this case, an array of connectors that contact opposing LGA pads) is the fuzz button connector, which is a polymer sheet that a very fine diameter molybdenum wire with numerous coatings, the last of which is predominantly gold. The connector is entangled and compressed, much like a steel wool pad, and then press-fit into the holes of the polymer sheet. Each connector is discretely formed and there is a tendency for a connector to fall out of the hole. Considerable force is required to maintain the contact between each connector and the LGA pad. There is also a very limited contact area between the fine diameter wire and the LGA pads. The connector size presents a problem because the pitch between pads needed for increasing Input/Output (I/O) density on a substrate requires very small, but accurately placed, connectors. The processes of handling and repairing small, discrete spring connectors approaching 15 to 20 mils in diameter is difficult at best. Consequently, an integrated connector array is required.

Specific examples that teach the use of discrete springs to effect interconnection between pads and metallized connectors may be seen in U.S. Pat. No. 5,139,427 issued to Boyd et al. on Aug. 18, 1992, and in a sales brochure by Servometer Corporation of Cedar Grove, N.J. The sales brochure teaches the use of discrete bellows for electrical connections. These bellows are manufactured from electrodeposited nickel and gold and are designed to provide force repeatability. Each bellows is a discretely formed cylindrical structure ranging in diameter from 0.037 inches to 0.125 inches outside diameter. At one end of the bellows, a contact having a convex conical tip is formed. At the other end, a contact having a convex conical receptacle is formed. Each bellows is discretely mounted on a substrate surface by inserting the receptacle end onto a pin and press fitting it into place. Alternatively, the receptacle end may be spot welded to a pin or soldered into place.

Discrete bellows used for an electrical array may have the same problems as the discrete fuzz buttons. The use of discrete bellows in high-density I/O applications may not be feasible. The processes of handling and repairing discrete small springs approaching 15 to 20 mils in diameter is impractical and very expensive. Therefore, a need exists for a process and structure which increases reliability and decreases the complexity of fabrication of the connection between an area array package and a supporting substrate.

SUMMARY OF THE INVENTION

To meet this and other needs, and in view of its purposes, the present invention is directed to a compliant, high-density LGA connector formed on a supporting substrate and its process of fabrication. The process forms a structure having a plurality of contacts on the surface of a substrate, which may connect to complementary LGA pads on a printed circuit board, circuit module, chip carrier, or the like. The contacts may be made en-masse and, therefore, are suitable for high-density LGA connections.

In one embodiment, the invention includes forming holes in a supporting substrate. Next, threaded sidewalls are formed by tapping the holes. The threaded sidewalls are plated to form bellows-like structures. A surface of the supporting substrate is etched after the plating. The process includes roughening the surface prior to etching. Tapping of the holes is accomplished with a tap preferably having rounded convoluted edges. The substrate may be a printed circuit board, a circuit module, or a chip carrier. In another embodiment, both surfaces of the supporting substrate are etched to expose the bellows-like structures on both sides of the substrate. In yet another embodiment, the threaded holes are made in a die having screw-like mandrels.

It is understood that the foregoing general description and the following detailed description are exemplary, but are not restrictive, of the invention.

BRIEF DESCRIPTION OF THE DRAWING

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

The present invention is directed to a compliant, high-density LGA connector formed on a supporting substrate and to its process of fabrication. The present invention is used to join semiconductor chips and circuit modules, such as LGA modules, to a substrate, such as a printed circuit board, a microelectronic circuit card, or any organic or ceramic chip carrier or circuit card. The present invention may also be used to join circuit boards or circuit cards together.

Figure 1A:
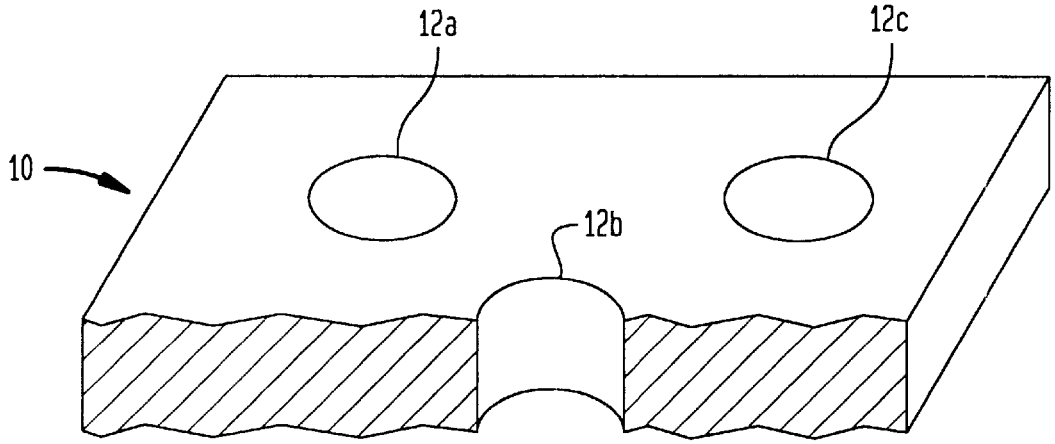
FIGS. 1*a*, 1*b*, 1*c*, and 1*d* are enlarged perspective views of a supporting substrate at various stages of fabrication in accordance with the present invention.

The preferred embodiment for the process of fabricating the compliant, high-density LGA connector is shown in FIGS. 1*a*–1*d*. In the first step, shown in FIG. 1*a*, a plurality of through-holes 12*a*, 12*b*, and 12*c* are drilled or mechanically punched into or through supporting substrate 10. Supporting substrate 10 may be, for example, an insulator used as a printed circuit board or a chip carrier. Although only three through-holes are shown in FIG. 1*a*, it will be appreciated that typically an array of holes may be drilled or mechanically punched into supporting substrate 10. Furthermore, the holes need not be drilled completely through substrate 10, as long as the depth of each hole is sufficient to allow placement of the desired number of threads in the subsequently explained tapping step. The array of holes is formed on centers which are complementary to the pads of the LGA module to be connected. The holes are preferably formed in an array on a large support substrate which can subsequently be cut into smaller arrays for individual LGA connector applications. Thus, gang drilling, punching, and threading may be used to improve production efficiency.

Figure 1B:
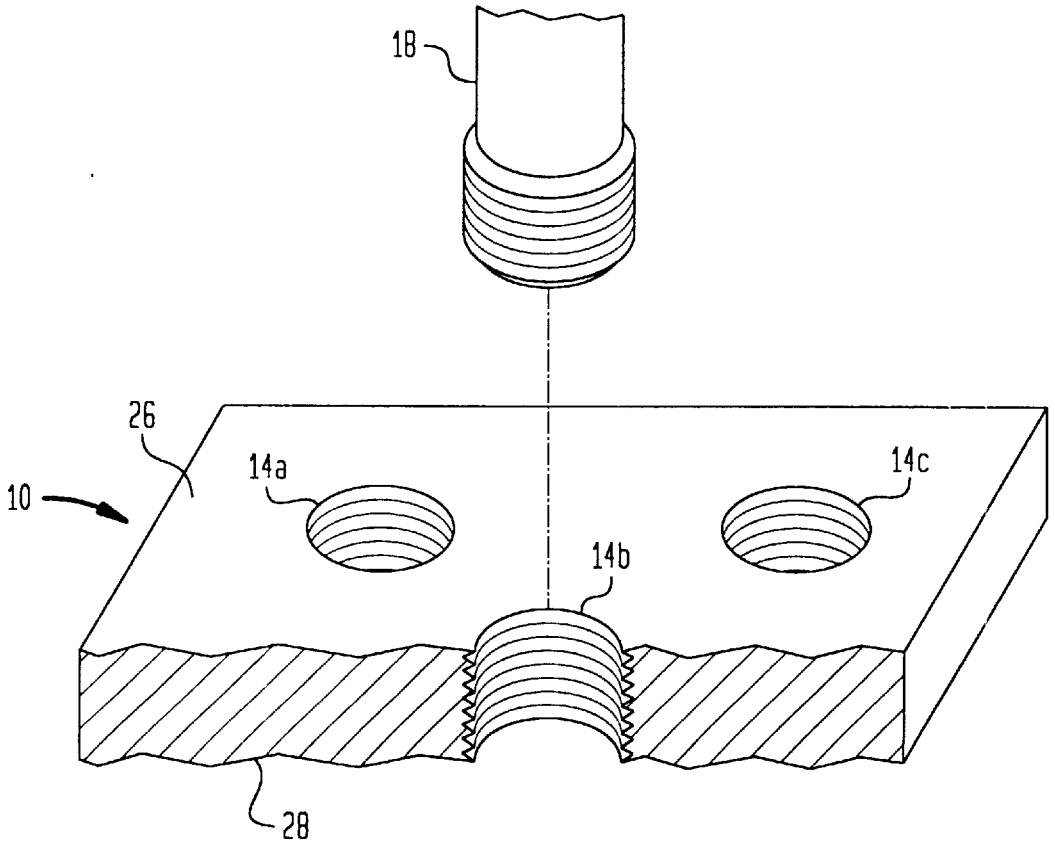

In the second step, shown in FIG. 1*b*, threaded sidewalls 14*a*, 14*b*, and 14*c* are made by threading through-holes 12*a*, 12*b*, and 12*c*, respectively, with tap 18. Preferably, threaded sidewalls 14*a*, 14*b*, and 14*c* may extend continuously from the top surface 26 to the bottom surface 28 of the substrate. For applications where protruding bellows are desired on only one side, blind holes may also be made. These may be used to connect to electrical wiring buried within substrate 10 (not shown) and to surface pads (not shown).

Figure 1C:
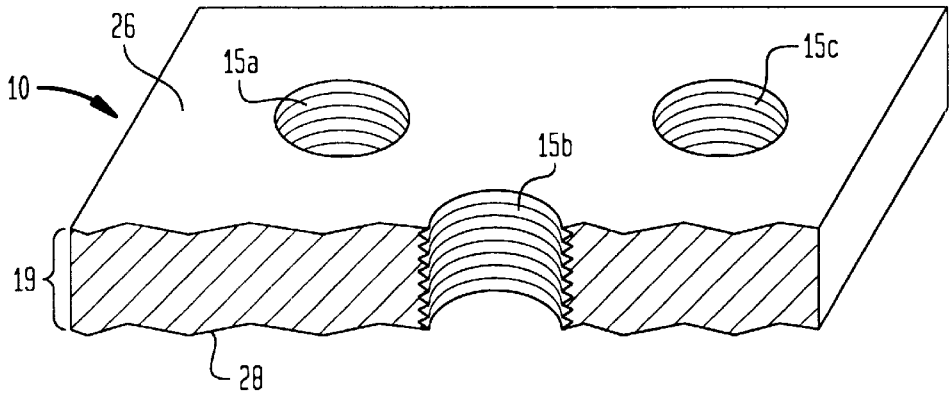

Next, as shown in FIG. 1*c*, the inside of the threaded holes are plated with a metal having a high yield strength and a low elastic modulus to form metal plated structures 15*a*, 15*b*, and 15*c*. As the threaded holes are plated with the metal, the radial outer edges of the plated structures 15*a*,

15*b*, and 15*c* conform to the radial contours of the threaded sidewalls. The plating metal may be chosen from the group including nickel, copper, cobalt, rhodium, and molybdenum. Plating may be done by conventional mechanisms using any number of commercially available plating baths. It is desirable to control the plated thickness to balance the effects of the mechanical and electrical properties of the deposited metal. It is also desirable to achieve a thickness that may permit the metal to elastically deform during stressing conditions, but have high resistance to permanent deformation. As shown in FIG. 1*c*, the thickness of supporting substrate 10 is represented by reference number 19. If desired, a temporary mask may be applied over surfaces 26 and 28 of substrate 10 prior to drilling, threading and plating to prevent plating of these surfaces. Alternately, the top and bottom surfaces may be plated as the threaded holes are plated. This plating may then be removed in the following step.

Figure 1D:
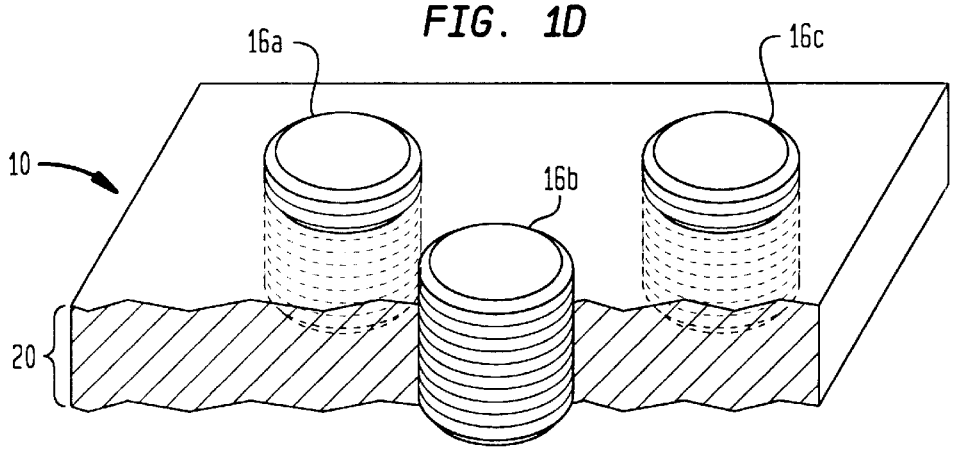

The next step is shown in FIG. 1*d*. At least one surface of the supporting substrate is etched by a chemical process, so that the metal plated threaded hole structures are exposed and protrude above the etched surface. The etching of the supporting substrate may be done in a conventional manner by using acid, alkaline, or other solvent solutions. The concentration, temperature, and etching time may be determined by the etching rate and durability differences between the plated metal and the substrate materials. Alternatively, etching processes such as reactive-ion etching (RIE) or RF generated plasma etching may be performed. The removal of material from supporting substrate 10 by the etching process leaves supporting substrate 10 with a reduced thickness represented by reference number 20 in FIG. 1*d*. Clearly, thickness 20 is less than thickness 19.

Figure 2:
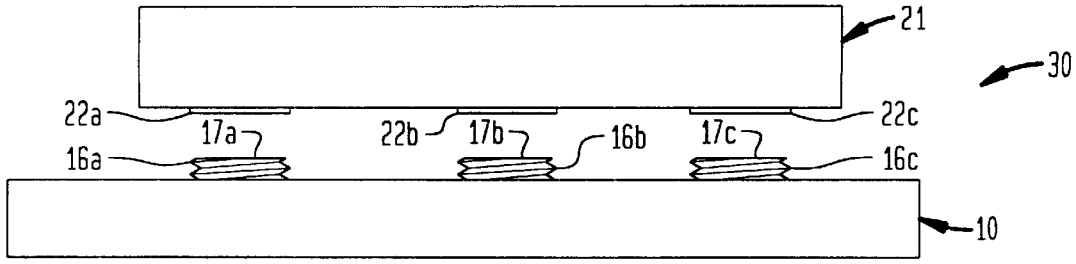
FIG. 2 is an enlarged cross-sectional view of the supporting substrate of FIG. 1 at a stage ready to be connected to an LGA module.

The exposed metal structures form bellows 16*a*, 16*b*, and 16*c*, each having a bellow-like appearance due to the radial contours of the threaded sidewalls. The bellows, shown in a cross-sectional view in FIG. 2, may now be used for making electrical contact to other conductive surfaces, for example, LGA pads 22*a*, 22*b*, and 22*c* of LGA module 21.

As an additional step (not shown), the exposed top surfaces 17*a*, 17*b*, and 17*c* of bellows 16*a*, 16*b*, and 16*c* may be roughened to provide better electrical connection with LGA pads 22*a*, 22*b*, and 22*c*. This step may be done prior to etching substrate 10, by roughening the top surface 26 of the substrate with either sandpaper, abrasive pads, or the like. In this manner, connections may be formed between the top surfaces of the bellows and the LGA surface pads of a mating module with minimum resistance and capacitive coupling.

Another step (not shown) may include plating the bellows 16*a*, 16*b*, and 16*c* with gold so that the exposed surfaces are prevented from tarnishing. If gold plating is performed, then it should preferably be performed after roughening the top surface of the substrate.

Figure 3:
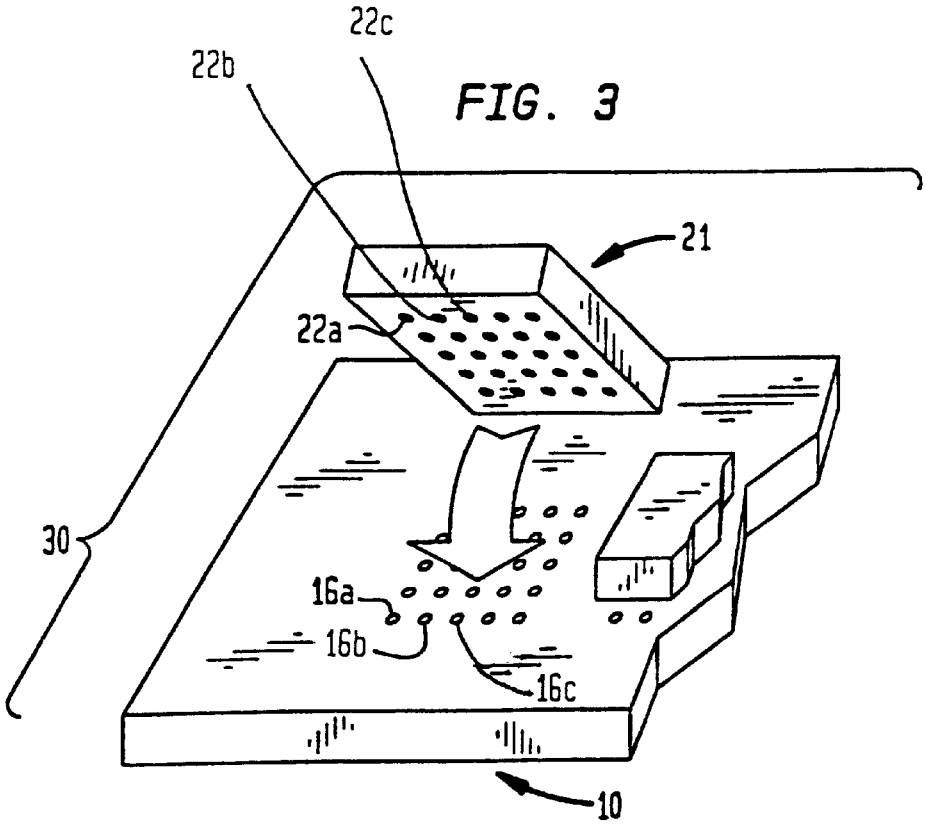
FIG. 3 is a perspective view of an unassembled microelectronic circuit package showing the supporting substrate of FIG. 2 ready to be connected to an LGA module.
Figure 4:
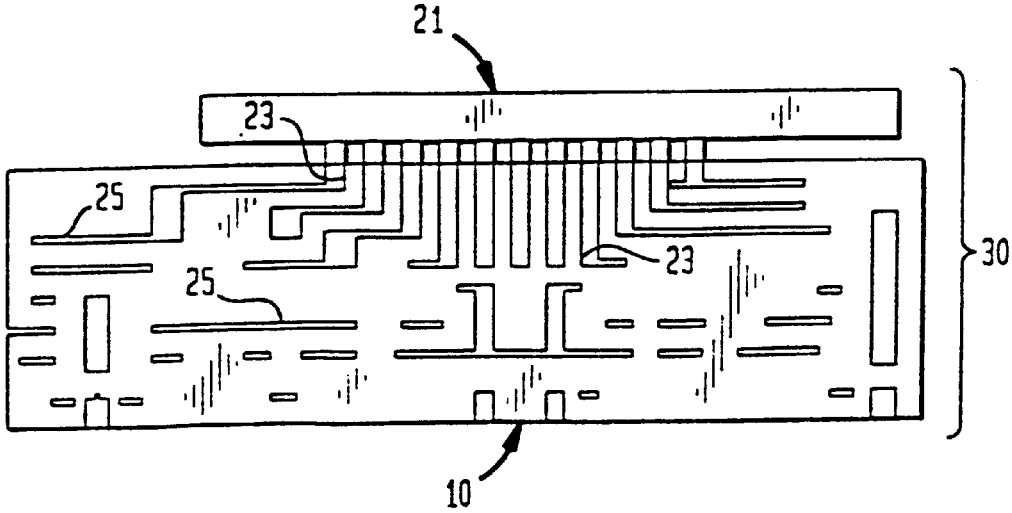
FIG. 4 is a cross-sectional view of the assembled microelectronic circuit package of FIG. 3.

The completed structure of the microelectronic circuit package 30 is shown in FIGS. 3 and 4. As shown, FIG. 3 is a perspective view of LGA pad 21 about to be connected with supporting substrate 10. LGA pads 22*a*, 22*b*, and 22*c* are placed on top of bellows 16*a*, 16*b*, and 16*c* and held in place without solder by a conventional fastening structure providing a compressive force on the connections (not shown). FIG. 4 depicts a cross-sectional view of the microelectronic circuit package 30 after having been assembled together. In the embodiment shown, substrate 10 may be a printed circuit board, for example, having vias 23 electrically contacting bellows 16*a*, 16*b*, and 16*c* and power planes 25.

The protruding bellows, as a connector array, are particularly suited for LGA connections because each bellow may be made compressible without permanent deformation. Adequate elastic deflection (greater than 3 mils) may result under reasonable loads (50 g) in order to compensate for non-planarity of the substrate. Calculations show that the deflection does not exceed the yield point of plated nickel when used as the connector material and, moreover, the deflection is repeatable well beyond the anticipated duty of the connector when subjected to cyclic testing.

Figure 5A:
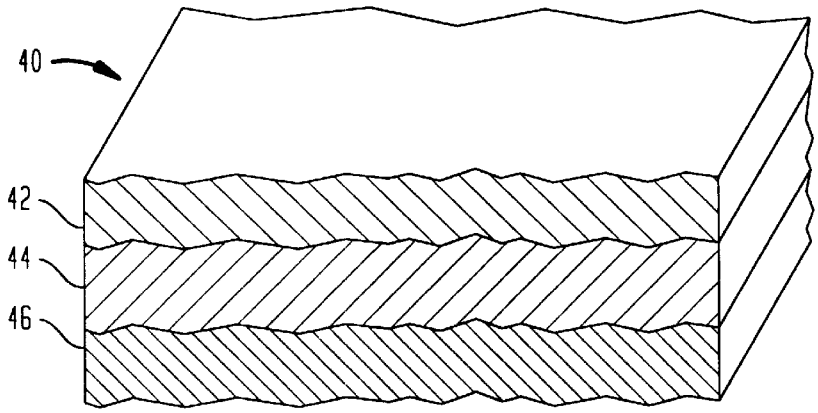
FIGS. 5*a*, 5*b*, and 5*c* are enlarged perspective views of a supporting substrate at various stages of fabrication in accordance with another embodiment of the present invention.
Figure 5B:
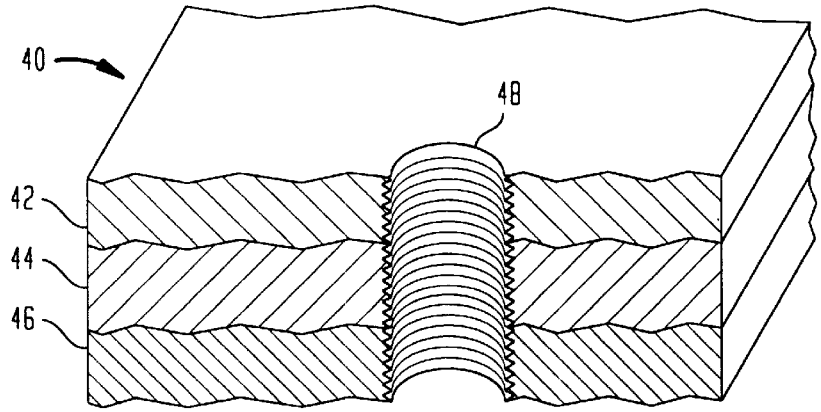
Figure 5C:
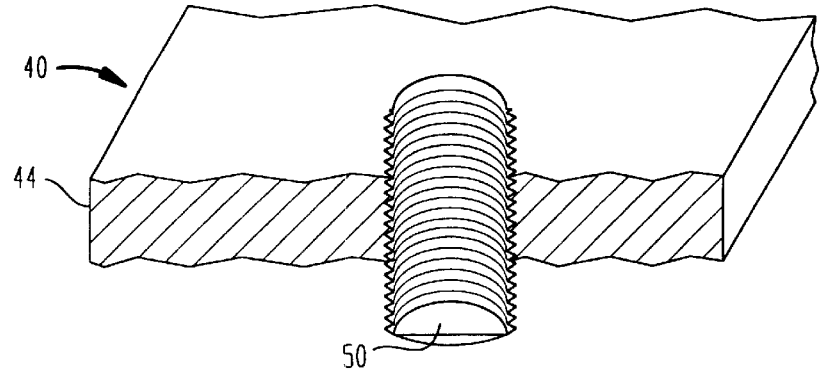

Another embodiment of the present invention is shown in FIGS. 5*a*, 5*b*, and 5*c*, which illustrate the fabrication process of another compliant, high-density LGA connector. A multilayer structure 40 is used as the starting point for making the LGA connector. As shown, support carrier 44 is sandwiched between top layer 42 and bottom layer 46. The multilayer structure may be used to provide an array of connectors for contacting LGA pads on both sides of the array. Thus, the outer two layers (top layer 42 and bottom layer 46) may be chosen from material which is more easily removable than the inner, permanent support layer of support carrier 44.

The steps of the fabrication process for multilayer structure 40 proceed in a sequence similar to that described above. First, multilayer structure 40 is provided as shown in FIG. Sa. Multilayer structure 40 is drilled or tapped to make an array of holes on centers complementary to the LGA pads (not shown). After drilling, the holes are tapped to produce threaded sidewalls 48 (FIG. 5*b*). The holes are then plated to form the bellows and the exposed surfaces of multilayer structure 40 are roughened (not shown). Next, the structure is etched in a conventional manner, until only the inner layer (support carrier 44) remains. In this manner, support carrier 44 remains with bellows 50 protruding on both of its surfaces, as shown in FIG. 5*c*. The support carrier may be chosen from a number of plateable, stiff polymers such as polyimides, polyamides, epoxies, and the like. Such materials are typically used as metallization supports for printed circuit boards and chip carriers in the electronics industry.

It will be appreciated that the bellows 50 may be made to protrude on one side only, or on both sides, of support carrier 44. If the LGA connector is made on one side only, the other side may be used for solderable pads that allow the connector array to be soldered in place, thus helping alignment.

In another embodiment, the process may start with a structure having only two layers. For example, the multilayer structure 40 may only include top layer 42 and inner layer 44, without bottom layer 46. The top layer is then etched, resulting in bellows 50 protruding on one side only. The other side may be used for soldering to a surface pad.

Figure 6A:
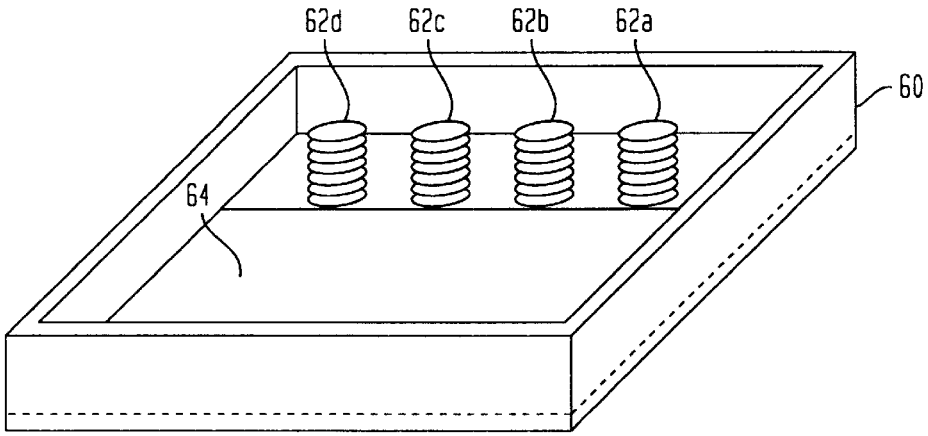
FIGS. 6*a* and 6*b* are perspective views of a mold box having threaded screws protruding from its underside for forming a supporting substrate in accordance with yet another embodiment of the present invention.
Figure 6B:
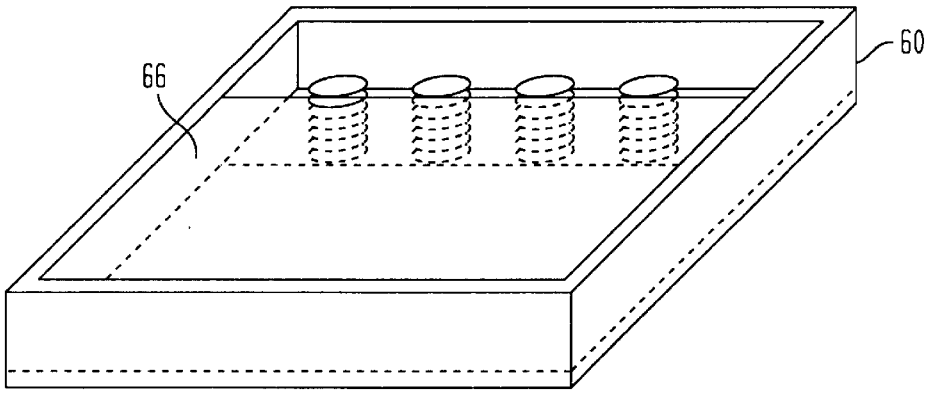

It will also be appreciated that the threaded sidewalls of the supporting substrate may be formed in a manner other than by punching, drilling, and tapping. The threaded sidewalls may be formed by a casting or molding technique using mandrels. The mandrels may consist of an array of protruding threaded screws, as shown in FIG. 6*a*. Mold box 60 is shown having an array of threaded screws 62*a*, 62*b*, 62*c*, and 62*d*, which protrude above the bottom surface 64 of mold box 60. The array of threaded screws may be attached to a gear train (not shown) at the bottom of the mold box to allow the screws to be unscrewed from the mold box. After the screws are in place, a polymer may be poured or injected into mold box 60 to form polymer sheet 66, as shown in FIG. 6*b*. The polymer sheet is cured to form a sturdy carrier for the connector. The threaded screws are then removed and polymer sheet 66 is now ready for plating and etching in the same manner described above.

Figure 7:
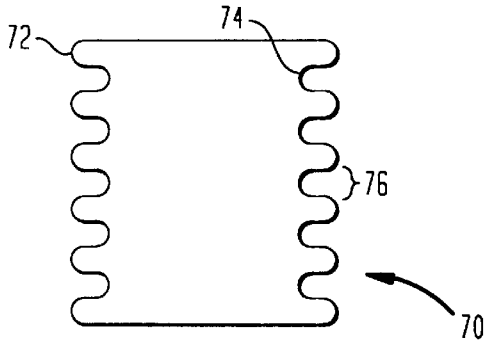
FIG. 7 is a cross-sectional view of a bellows-like structure in accordance with the present invention.

Lastly, FIG. 7 shows an enlarged cross-sectional view of a single bellows 70. In its preferred shape, bellows 70 is comprised of rounded convoluted edges formed from a threaded screw having round edges. As shown, convoluted outer edge 72 and convoluted inner edge 74 are both rounded in shape. The rounded edges provide the greatest fatigue resistance for multiple compressions along the length of the exposed connector. The convolution pitch 76 may vary and is a function of the required fatigue resistance and the length of the exposed connector.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention. It will be understood, for example, that the present invention is not limited to only the LGA connector described. Rather, the invention may be extended to be used as an interposer between a package and a printed circuit board or between any two substrates that may repeatedly be assembled and unassembled.

What is claimed:

1. A process for making a compliant, high-density land grid array connector comprising the steps of:

a) forming holes in a supporting substrate;

b) forming threaded sidewalls by tapping the holes;

c) plating the threaded sidewalls to form bellows-like structures; and d) etching a surface of the supporting substrate after the plating to leave portions of the bellows-like structures protruding past a surface of the substrate to form compliant contacts.

2. The process of claim 1 further comprising roughening the surface prior to the step d) of etching.

3. The process of claim 2 wherein step d) includes exposing the bellows-like structures above the etched surface.

4. The process of claim 1 wherein step b) includes tapping the holes with a tap having rounded convoluted edges.

5. The process of claim 1 further comprising the step of (e) depositing gold on the bellows-like structures after the etching.

6. The process of claim 1 wherein step a) includes forming the holes in an array, each hole having a center complementary to each pad of a land grid array module.

7. The process of claim 6 wherein the substrate is one of a printed circuit board, a circuit module, and a chip carrier.

8. The process of claim 1 wherein step d) includes etching a further surface of the supporting substrate to expose the bellows-like structures from both etched surfaces.

9. The process of claim 1 wherein step a) is done by one of punching and drilling, and step b) is done by tapping with a threaded screw.

10. The process of claim 1 wherein step a) includes forming the supporting substrate from three layers of polymer, the center layer being of a more chemically stable polymer than the outer two layers, and step d) includes etching until the center layer is exposed.

11. The process of claim 1 further comprising the step of e) assembling the connector with a land grid array module to form a microelectronic circuit package.

12. The process of claim 1 wherein step (a) includes forming the supporting substrate from two layers of polymer, the first layer being of a more chemically stable polymer than the second layer, and step (d) includes etching the second layer until the bellows-like structures are exposed above the etched surface.

13. The product made by the process of claim 1.

14. A high-density land grid array connector for electrically connecting to pads of an LGA module, said connector comprising:

a supporting substrate having a surface and threaded holes; and an array of structures resistant to permanent deformation when compressed, disposed in said supporting substrate, and protruding above said surface of said substrate, each structure comprising a metal formed by plating the threaded holes and etching the surface after plating to leave portions of the metal protruding past the surface, said metal forming a radial exterior with a bellows-like shaped portion along said radial exterior and having an end for electrically contacting one of said pads.

15. The connector of claim 14 wherein said bellows-like shaped portion has a rounded convoluted outer edge and a rounded convoluted inner edge along said radial exterior.

16. The connector of claim 15 wherein said end is roughened.

17. The connector of claim 16 wherein said metal is one of a group consisting of nickel, copper, cobalt, rhodium, and molybdenum.

18. The connector of claim 17 wherein said structures are gold plated to prevent corrosion.

19. A process for making a compliant, high-density land grid array connector comprising the steps of:

(a) providing a die having screw-like mandrels;

(b) casting a supporting substrate in the die;

(c) removing the screw-like mandrels to form threaded sidewalls in the supporting substrate;

(d) plating the threaded sidewalls to form bellows-like structures; and (e) etching a surface of the supporting substrate after the plating to leave portions of the bellows-like structures protruding past a surface of the substrate to form compliant contacts.

* * * * *